US006244186B1

(12) United States Patent
Pichard

(10) Patent No.: US 6,244,186 B1
(45) Date of Patent: Jun. 12, 2001

(54) AIR GUN PELLET

(76) Inventor: Joseph F. L. John Pichard, P.O. Box 129, Tompkins, Saskatchewan (CA), S0N 2S0

( * ) Notice: Subject to any disclaimer, the term of this patent is extended or adjusted under 35 U.S.C. 154(b) by 0 days.

(21) Appl. No.: 09/359,860

(22) Filed: Jul. 26, 1999

(51) Int. Cl.[7] ..... F42B 12/34
(52) U.S. Cl. ..... 102/508; 102/501
(58) Field of Search ..... 102/501, 507–510, 102/517, 519

(56) References Cited

U.S. PATENT DOCUMENTS

| | | | | |
|---|---|---|---|---|
| D. 231,447 | | 4/1974 | Abbott . | |
| 3,557,656 | | 1/1971 | Precoul . | |
| 3,881,421 | | 5/1975 | Burczynski . | |
| 4,005,660 | | 2/1977 | Pichard . | |
| 4,048,922 | | 9/1977 | Buljovcic . | |
| 4,136,616 | * | 1/1979 | Schirneker | 102/510 |
| 4,413,564 | | 11/1983 | Brown . | |
| 4,979,443 | | 12/1990 | Rittel et al. . | |
| 5,175,389 | | 12/1992 | Kramer et al. . | |
| 5,185,495 | | 2/1993 | Petrovich et al. . | |
| 5,339,743 | * | 8/1994 | Scarlata | 102/509 |
| 5,385,100 | | 1/1995 | Crozine et al. . | |
| 5,471,719 | | 12/1995 | Sawyers . | |
| 5,515,787 | * | 5/1996 | Middleton | 102/509 |

FOREIGN PATENT DOCUMENTS

| | | | | |
|---|---|---|---|---|
| 614316 | * | 7/1978 | (RU) | 102/501 |
| WO 97/40334 | | 10/1997 | (WO) . | |

* cited by examiner

*Primary Examiner*—Harold J. Tudor
(74) *Attorney, Agent, or Firm*—Varnum, Riddering, Schmidt & Howlett LLP

(57) ABSTRACT

An air gun pellet with a head including two distinct structural features, providing overall improved performance. The first feature is a multiple section rim or cup on the head which enlarges or mushrooms upon impact. The second feature is a central driving point contained within the cup on the head. The combination of these features provides a synergistic effect resulting in a pellet having improved penetration, shock wave and tissue destruction.

10 Claims, 2 Drawing Sheets

AIR GUN PELLET

FIELD OF THE INVENTION

The invention relates to ammunition and in particular to pellets for compressed gas powered weapons, especially air rifles or air guns.

BACKGROUND OF THE INVENTION

Air gun pellets have either been designed for deep penetration or for "mushrooming" upon impact The two designs have opposite objectives and have entirely different effects. Pellets designed for deep penetration typically have pointed tips to drive the pellet deeper into the target. Pellets that are designed to mushroom open upon impact typically have a cup-shaped head which spreads open upon impact with the target. Mushrooming defines the deformation radially outwardly and subsequently towards the back of portions of the head of the pellet. Both designs have their advantages and disadvantages with respect to hunting.

Deep penetrating pellets drive further into the body of an animal but do not cause much damage with the result that. unless a vital organ or structure is hit, the animal is not struck down and thus, can escape. Cup headed pellets are designed for mushrooming spread open in the body, but do not penetrate deep enough into the body to damage major organs. They operate on a shock wave principle and may strike down an animal, but not permanently so that again the animal may escape.

It is not desirable when hunting to only wound an animal and permit the wounded animal to escape, since this will not only result in loss of the animal, but will expose it to prolonged suffering. Thus, the effectiveness of both penetrating and mushrooming pellets requires improvement. Hence, the need for a pellet which will not only penetrate deep into the animals body but also cause serious damage to vital organs.

SUMMARY OF THE INVENTION

It is an object of the invention to provide a pellet for a weapon powered by compressed gas such as air, the pellet having a head for both high impact and penetration into the target.

This is achieved with a pellet for a compressed gas powered weapon including a pellet head having a circumferential rim with means for promoting sectioning of the rim and mushrooming on impact and a central penetration point. The pellet is designed so that the rim will spread open on impact and mushroom while the central point will provide penetration into the target, resulting in a larger and longer wound channel.

The pellets are preferably made of a relatively soft material which will allow for easy mushrooming upon impact, such as fead.

DETAILED DESCRIPTION OF THE PREFERRED EMBODIMENTS

Figure 1:
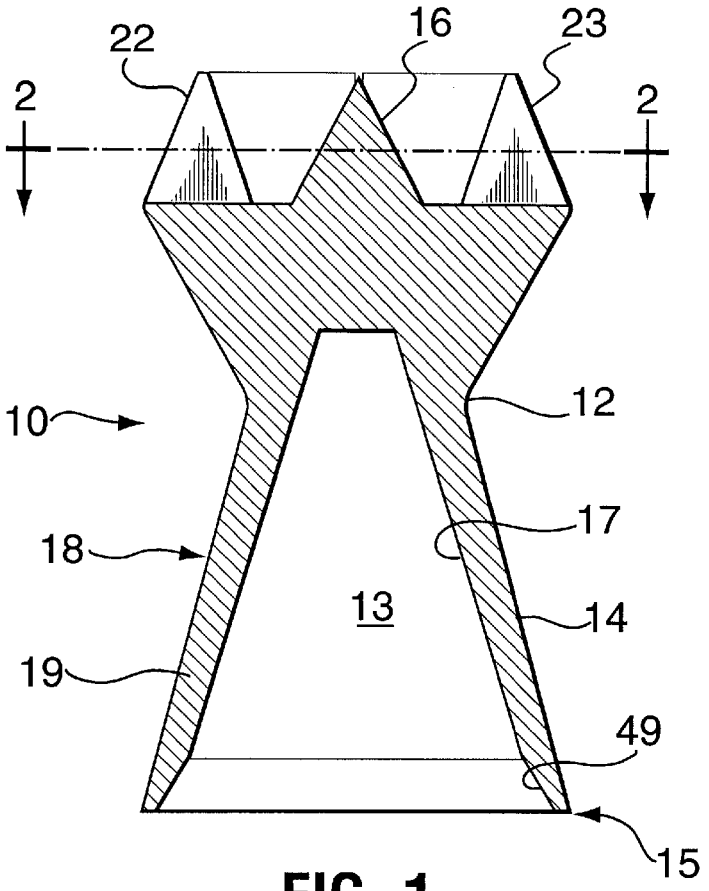
FIG. 1 is a sectional view of a pellet in accordance with the invention and before impact.
Figure 2:
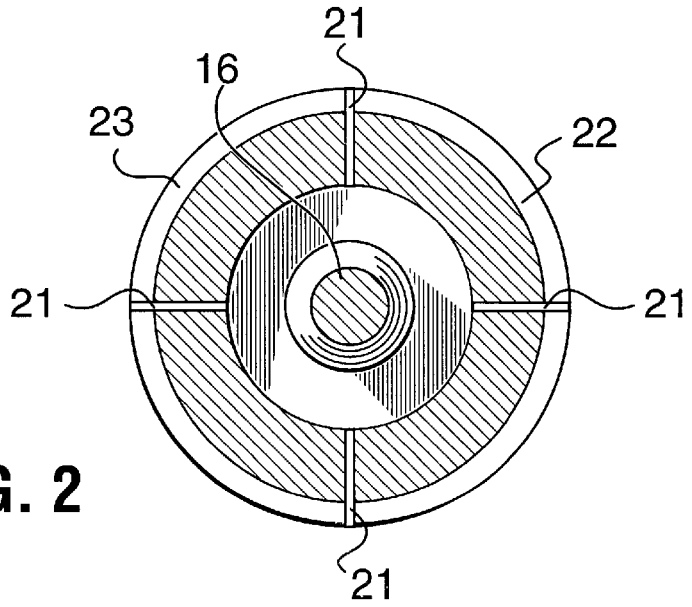
FIG. 2 is a top view of me pellet of FIG. 1.

A preferred embodiment of the pellet 10 in accordance with the invention is shown in FIG. 1 and has the conventional features of a forward head portion 11, and a rearward tail portion 18 including a waist portion 12 connected with the head portion 11, a hollow, conical skirt 14 defining a conical propulsion air pocket 13, and a land portion 15 extending along the annular rear end of the skirt 14, as well as the novel features of a forwardly protruding circumferential bulge or rim 22 on the head with a plurality of radial slits 21 extending partially or completely radially through the wall of the rim 22 (see FIG. 2*a*). The rim is thereby divided into sections or expansion panels 23. The head portion 11 typically has at least four expansion panels 23 which are shaped and constructed to open radially outward and curl backward upon impact with a target. In this embodiment, the head portion 11 is of circular cross section with an annular rim 22. The radius of the head portion 11 depends on the caliber of the gun in which the pellet is to be used. Although heads of different cross section are conceivable, their cross section should be symmetrical to a longitudinal axis of the pellet and preferably circular. Any number of rim sections or expansion panels 23 can be used as long as the circumferential ring or rim 22 reliably separates into multiple expansion panels 23 for "mushrooming" on impact. Mushrooming increases the shock wave created upon impact.

Referring to FIG. 1, the head 11 of the pellet 10 is further provided in the central recess defined by the circumferential rim 22 with a centrally located penetration point 16 which is of equal height to the circumferential rim 22 and conically widens towards its base. The point 16 serves to promote deeper penetration of the target after the initial impact.

Figure 4:
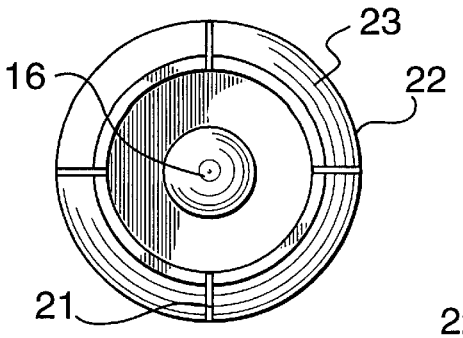
FIG. 4 is a top view of the pellet of FIG. 3.
Figure 5:
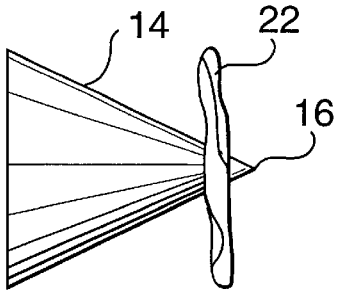
FIG. 5 is a sectional view of the pellet of FIG. 3.
Figure 6:
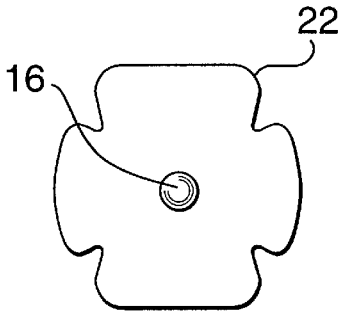
FIG. 6 is a sectional view of the pellet on initial impact, before full mushrooming.
Figure 7:
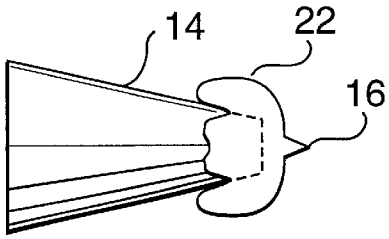
FIG. 7 is a side view of the pellet, after full mushrooming.
Figure 3:
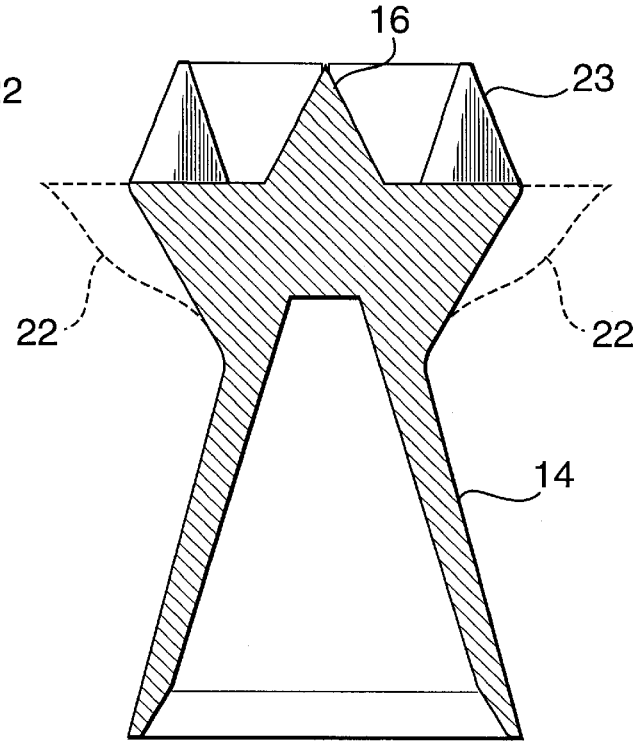
FIG. 3 is a side view of the pellet on initial impact, and at partial opening before full mushrooming.
Figure 8:
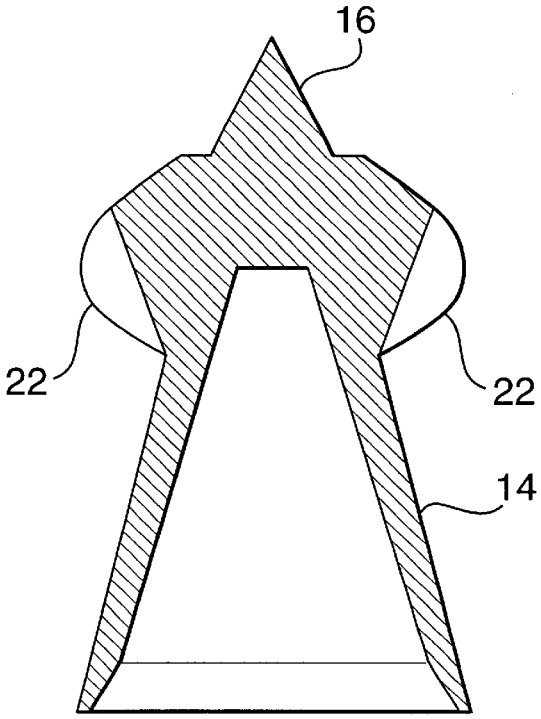
FIG. 8 is a sectional view of the pellet of FIG. 7.

FIGS. 4 to 8 illustrate the mushrooming of the pellet 10. FIGS. 3, 4 and 5 illustrate the pellet 10 on initial impact with the expansion panels 23 partially opened. FIG. 6 illustrates the pellet 10 on initial impact with the expansion panels 23 opened further but not fully opened (mushroomed). FIGS. 7 and 8 illustrate the mushroomed pellet 10 with the expansion panels 23 fully deformed outward and rearward (mushroomed).

Although the expansion panels in the preferred embodiment as illustrated are completely separated by the intermediate slits 21 produced by cuffing the rim 22, the rim can be sectioned in a variety of ways. The term section or sectioned as used herein is intended to cover a rim which is partitioned by any means which provides a dividing of the rim 22 into individual expansion panels before or upon impact for reliably achieving a mushrooming effect. For example, the slits 21 can be replaced with lines of perforations extending through the rim 22 or lines of weakness in the form of scratches, grooves, indentations, etc. located on the inside wall , the outside wall, or both sides of the rim. Partial cuts or slits 21 can be used as well, or any combination of these means for partitioning the rim. FIGS. 1 to 8 illustrate the conical point 16 of the pellet 10 in various views and at different stages of mushrooming.

Although the point 16 in this embodiment has a sharp tip, as illustrated in the figures, it could also be rounded or even flat, as long it still provides the bullet with improved penetration characteristics compared to a bullet without the penetration point.

The rearward portion 18 including the waist portion 12, the hollow, conical skirt 14, and the land portion 15 is conventional and comprises a generally frustoconical bore 17 widening rearwardly towards the land portion 15. Multiple variations of this general construction are commonly known in the art and can all be used in the pellet in accordance with the invention so that no detailed discussion thereof need be provided for a full understanding of all rearward portion variants by the person skilled in the art.

In the preferred embodiment, the skirt wall 19, as in conventional projectile cross-sections, increases in thickness towards the head 11 of the pellet 10. The rearward part of the skirt wall 19 comprises an axially-short portion 49 with an interior apical angle which is larger than the interior angle of the skirt 14.

Although the pellet 10 is illustrated with a frustoconical bore 17 used for thrusting the pellet forward from the barrel of the gun, the head 11 may be applied with any configuration of rearward portion 18 used to propel the pellet 10 forward from the barrel of a gun.

The effect of using a pellet 10 that has a head 11 which combines the features of both multiple expansion panels 23 and a central point 16 is to cause deeper internal damage to the target. This creates immediate internal damage to vital organs such as heart, lungs, arteries, etc. Thus, loss of the target animal and its unnecessary prolonged suffering is substantially avoided.

Various modifications to the shape and construction of the head portion 11 and the tail portion 18 are possible, provided that the head portion includes both a mushrooming structure and a penetrating structure.

The head portion 11 in another preferred embodiment is triangular in shape instead of a circular cross section or has a polygonal shape. The tail portion 18 can have a cylindrical shape (either internal, external or both) instead of the conical shape shown in the drawings, and a rearward portion whose land portion was not in continuous contact with the rifling of the gun barrel could be used as well, as long as a sufficient seal with the barrel is achieved for reliable propulsion of the bullet in and from the barrel.

Although the penetration point 16 and the rim 22 are of equal height in the preferred embodiment, the penetration point can have a height larger or smaller than the rim, depending on the degree of penetration desired. Furthermore, although the penetration point 16 preferably has a circular cross-section, it can also have an irregular cross-section resulting in an overall asymmetrical shape, or can have a multi-faceted outer surface with an overall multi-sided shape, such as pyramidal.

The expansion panels 23 are preferably of equal shape and size to provide symmetrical mushrooming of the head 11. However, expansion panels of different shape and size can also be used in a pellet in accordance with the invention. The differing panels can then be arranged symmetrically to the longitudinal axis of the pellet. The land portion 15 can be omitted, but is preferred for improved sealing of the skirt 14 against the barrel wall (not shown).

Changes and modifications in the specifically described embodiments can be carried out without departing farm the scope of the invention which is intended to be limited only by the scope of the appended claims.

What is claimed is:

1. A full-caliber pellet for a compressed gas powered weapon, comprising a forward head portion a rearward tail portion having a hollow propulsion air pocket, and an intermediate waist portion, the head portion having a front end including a circumferential rim protruding forwardly from the front end and a penetration point radially spaced apart from the circumferential rim and protruding from the front end for promoting penetration of the pellet into a target, the rim having at least two sections for mushrooming upon impact.

2. The pellet of claim 1, wherein the head is circular in cross section, and the rim is circular and includes at least two radial slits for dividing the rim into the at least two sections.

3. The pellet of claim 1, wherein the penetration point is of a conical shape.

4. The pellet of claim 1, wherein the pellet is constructed of a material promoting deformation of the rim on impact.

5. The pellet of claim 1, wherein the rearward tail portion has a frustoconical, hollow skirt for propulsion of the pellet through a barrel of the weapon.

6. The pellet of claim 1, wherein the penetration point is positioned centrally on the front end.

7. The pellet of claim 1, wherein the penetration point and the rim are concentrical.

8. The pellet of claim 1, wherein the penetration point has a height equal to a height of the rim.

9. A full caliber pellet for a compressed gas powered weapon, comprising a forward head portion, a rearward tail portion having a hollow propulsion air pocket, and an intermediate waist portion, the head portion having a front end including a circumferential rim protruding forwardly from the front end and a penetration point spaced apart from the circumferential rim and protruding from the front end for promoting penetration of the pellet into a target, the rim having at least two sections for folding outwardly and rearwardly upon impact, and the head portion being rearwardly tapered toward the waist portion for permitting the rim to be folded behind the head portion during mushrooming for sustained penetration after impact.

10. The pellet as defined in claim 9, wherein the front end includes an annular, planar front surface extending between the penetration point and the circumferential rim.

* * * * *

UNITED STATES PATENT AND TRADEMARK OFFICE

CERTIFICATE OF CORRECTION

PATENT NO. : 6,244,186 B1
DATED : June 12, 2001
INVENTOR(S) : Pichard, Joseph F.L. John It is certified that error appears in the above-identified patent and that said Letters Patent is hereby corrected as shown below:

Column 4, claim 1,
Line 12, a comma should be inserted after the word "portion";

Column 4, claim 9,
Line 37, a hyphen should be inserted between the words "full" and "caliber".

Signed and Sealed this

Twenty-ninth Day of January, 2002

*Attest:*

*Attesting Officer*

JAMES E. ROGAN
*Director of the United States Patent and Trademark Office*